United States Patent [19]

Lemel

[11] Patent Number: 4,586,637

[45] Date of Patent: May 6, 1986

[54] SLIP PREVENTING MEANS FOR GARMENT HANGERS

[76] Inventor: Seymour Lemel, 9700 Glenfield Ct., #1406, Houston, Tex. 77096

[21] Appl. No.: 623,316

[22] Filed: Jun. 22, 1984

[51] Int. Cl.[4] ..... A47J 51/094

[52] U.S. Cl. ..... 223/92; D6/328

[58] Field of Search ..... 223/92, 95, 98; D6/328

[56] References Cited

U.S. PATENT DOCUMENTS

| | | | |
|---|---|---|---|
| D. 223,103 | 10/1974 | Landin | D6/328 |
| 1,461,442 | 7/1923 | Duberstein | 223/92 |
| 2,667,293 | 1/1954 | Jacob | 223/92 |
| 2,904,233 | 9/1959 | Brothers | 223/92 |
| 3,168,970 | 2/1965 | Wilson | 232/92 |

*Primary Examiner*—Robert R. Mackey

*Attorney, Agent, or Firm*—Burton, Dorr & Carson

[57] ABSTRACT

Slip preventing means for garment hangers is provided by a flexible, sleeve-type member having (1) an upper surface of uneven contour, (2) flexible lip portions which curl under the upper surface to engage a top flange of a garment hanger having an I shaped cross section and one or more openings in its top flange, and (3) a cuff which also curls under the upper surface to engage one of the projections of the top flange which forms an end of the opening. The cuff section is open at both ends. It is located interior to the ends of the member to the extent that either end of the member will bridge the opening when the cuff engages a projection and thereby prevent garments hanging on the hanger from getting caught or torn in the opening as the garment is removed from the hanger.

5 Claims, 9 Drawing Figures

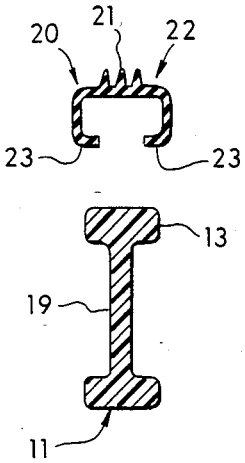
Fig. 2
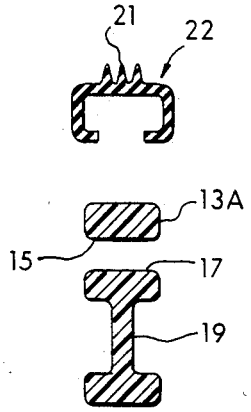
Fig. 3
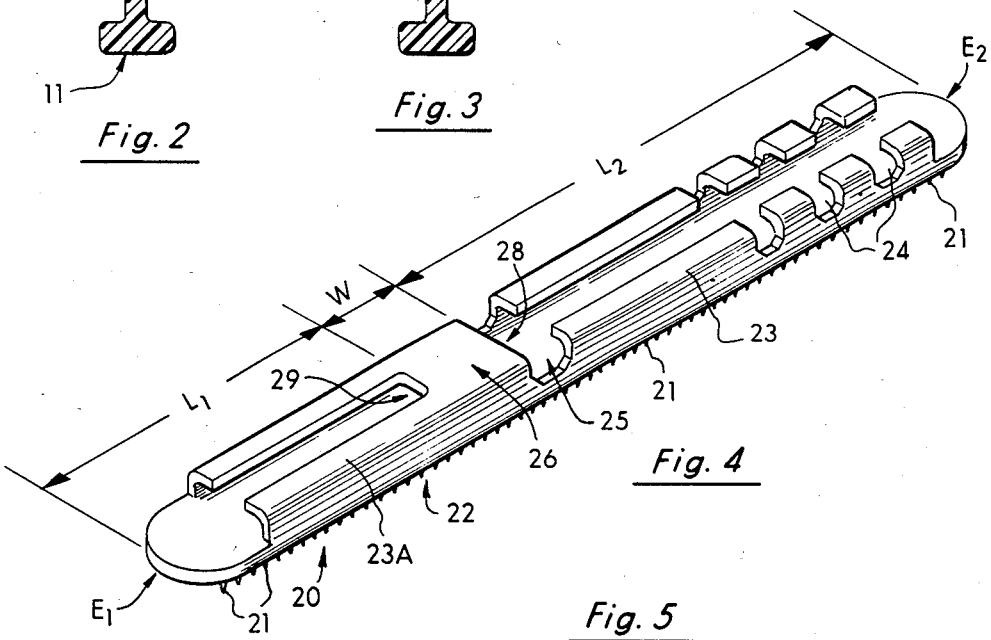
Fig. 4
Fig. 5
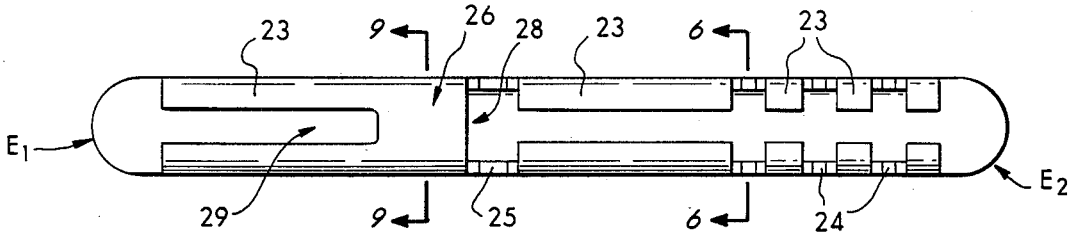
Fig.9
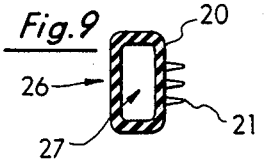
Fig.6
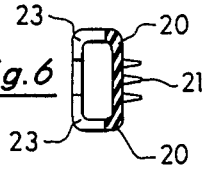
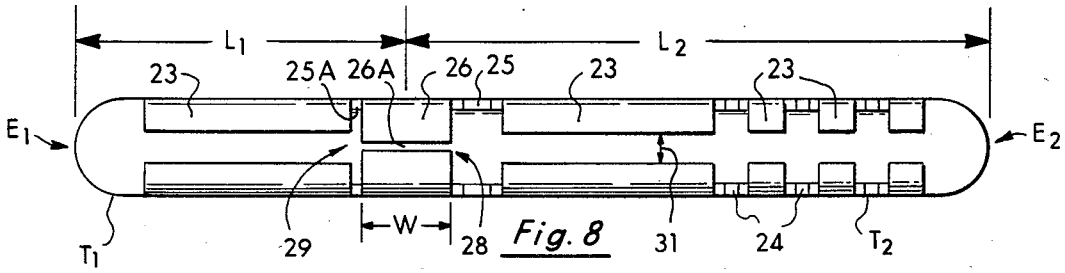
Fig. 8

SLIP PREVENTING MEANS FOR GARMENT HANGERS

BACKGROUND OF THE INVENTION

1. Field of the Invention

This invention relates to hangers having arms adapted to support items of clothing in display cases, closets and the like. More specifically, this invention relates to hangers having arms in which there are openings and slots in the upper surface and hooks in the lower surface upon which garments having various types of straps may be conveniently hung.

2. Description of the Prior Art

Slip preventing means for garment hangers having openings and slots on the upper surfaces of their arms for hanging garments which suspend from straps are well known. For example, U.S Pat. No. 3,168,970 ("the 970 patent") teaches a flexible sleeve-type member having a friction creating upper surface to aid in hanging garments, particularly hard surfaced or slippery garments such as silk blouses and silk dresses, on the above noted hangers which are normally used for hanging garments suspended from straps such as, for example, ladies' silk slips. These slip preventing means are attached to hangers of this type in a variety of ways. The means disclosed in the 970 patent are typical. They have a friction creating upper surface and lip portions which curl under the upper surface to engage the top flange of an arm of the garment hanger. The upper surface also has a cup-like closed end which is located on the underside of the upper surface at the very end of the member. This closed end engagingly encompasses and abuts against the end of a portion of the flange which projects over the top of one or more openings in the side walls of these hangers. A portion of the flange projects over the slot from the higher side of the arm and another portion of the flange projects over the slot from the lower side of the arm. The ends of the two projecting portions do not meet, but rather define the ends of an opening in the upper surface of the arm. The opening leads to the slot so that straps which support certain garments can be inserted into the opening and come to rest on the lower surface of the slot.

The cup-like closed end of these prior art slip preventing means can be fitted over that portion of the flange which projects over the opening from the upper side of the arm ("the upper projection") or, in the alternative, it can be fitted over that portion of the flange which projects over the slot from the lower side of the arm ("the lower projection"). When the cup-like closed end is fitted over the upper projection, the friction creating upper surface of the member extends from the end of the upper projection upward toward the upper part of the hanger arm where the collar region of the garment normally hangs. When the slip prevention means is in this position the friction creating surface of the member extends along the upper portion of the hanger arm, i.e., from the collar region of the hanger to the end of the upper projection which terminates at the upper end of the opening over the slot which is normally located near the middle of the shoulder portion of the hanger arm. Conversely, when the cup-like closed end of this type of slip preventing means is fitted over the lower projection, the friction creating upper surface of the member extends from the end of the lower projection toward the lower end of the hanger where the arm section of the garment normally is associated with the hanger.

However, this type of slip preventing means is characterized by the fact that, regardless of whether the cup-like closed end of the member is fitted to the upper projection or to the lower projection the opening in the upper surface of the hanger arm remains substantially open. That is to say that the upper surface of the member does not extend beyond the outside surface of the cup. Furthermore, the opening remains substantially open even if both the upper projection and the lower projection were each respectively encompassed by a slip preventing means having these cup-like closed ends.

The fact that these hanger arm openings are left substantially open when the slip preventing means of the 970 patent are used in conjunction with hangers having such openings and slots detracts from the versatility of these hangers. For example, many kinds of garments made of many fabrics, such as loose knit woolens or delicate nylon or silk, tend to get caught in the openings even when many prior art slip preventing means are utilized. Consequently, such loose knit garments are frequently damaged as they are removed from these hangers or moved on these hangers. As a precaution, these kinds of garments are often hung on hangers which do not have such openings.

Therefore, the principle purpose of my invention is to provide friction means adapted for installation on hangers having slots in the upper surfaces of their arms so that these hangers may be used for hanging loose knit garments as well as hard or slippery surfaced garments which require a friction creating upper surface. Another embodiment of my invention allows the openings and slots of these hangers to be used without removing the slip preventing means of this invention from the hanger. Hence these features serve not only to enhance the usefulness and variety of applications of these hangers, but also to greatly reduce the labor associated with providing hangers of this type with different kinds of slip preventing means for different kinds of garments.

SUMMARY OF THE INVENTION

This invention provides a slip prevention means in the form of a flexible, sleeve-type member having an upper surface of uneven contour. The member may have, for example, a plurality of short, bristle-like projections which define the uneven contour of the upper surface. This surface is adapted to be supported on the arm of hangers of the type previously noted so that when a garment is hung over the arm, it bears against the uneven contour. This in turn causes substantial friction forces to be exerted on the garment so that it does not slip from its proper position. The member also has finger-like gripping means which depend from the sides of the upper surface for engaging the hanger arm to keep the slip preventing means in place. This arrangement forms a channel shaped yoke-like underside to the member which rests on the hanger arm's upper surface. Also depending from the sides of the upper surface is a cuff which also curls under the upper surface. The cuff engages projecting portions of the upper surface of the hanger which form the ends of slots located in the upper surface of the hanger arm. The cuff completely or substantially encompasse one of the projecting portions of such hangers. The cuff is located far enough interior to the ends of the member that the ends of the member's upper surface bridge the opening in the hanger arm when the cuff is positioned on either of the two projecting portions of the hanger's upper surface.

This slip preventing means may be readily and inexpensively fabricated from any suitable flexible material such as, for example, semi-rigid polyethylene plastic or polyvinylchloride. So positioned, this slip preventing means substantially enhances the usefulness of such hangers for hanging garments in the usual manner, that is, over the arm of the hanger, so that garments do not easily slide out of place and wrinkle or fall off, or catch on the projections which form openings and slots in the upper surface of the hanger arm. Therefore, with the aid of my invention, one type of hanger may be used for all the hanging requirements of, for example, one large clothing store, and the added costs otherwise required for keeping many special purpose hangers available can be avoided.

These and other features of my invention are further described in more detail in the following portions of the specifications.

BRIEF DESCRIPTION OF THE DRAWINGS

In the description which follows, reference is made to the accompanying drawings in which:

FIG. 2 is a sectional view taken along line 2—2 of FIG. 1.

FIG. 3 is a sectional view taken along line 3—3 of FIG. 1.

FIG. 4 is a pictorial view of the embodiment of FIG. 1.

FIG. 5 is a bottom view of the embodiment of FIG. 1.

FIG. 6 is a sectional view taken along line 6—6 of FIG. 5.

FIG. 8 is a bottom view of a second embodiment of the slip preventing means of this invention.

FIG. 9 is a sectional view taken along line 9—9 of FIG. 5.

DETAILED DESCRIPTION OF THE INVENTION

Figure 1:
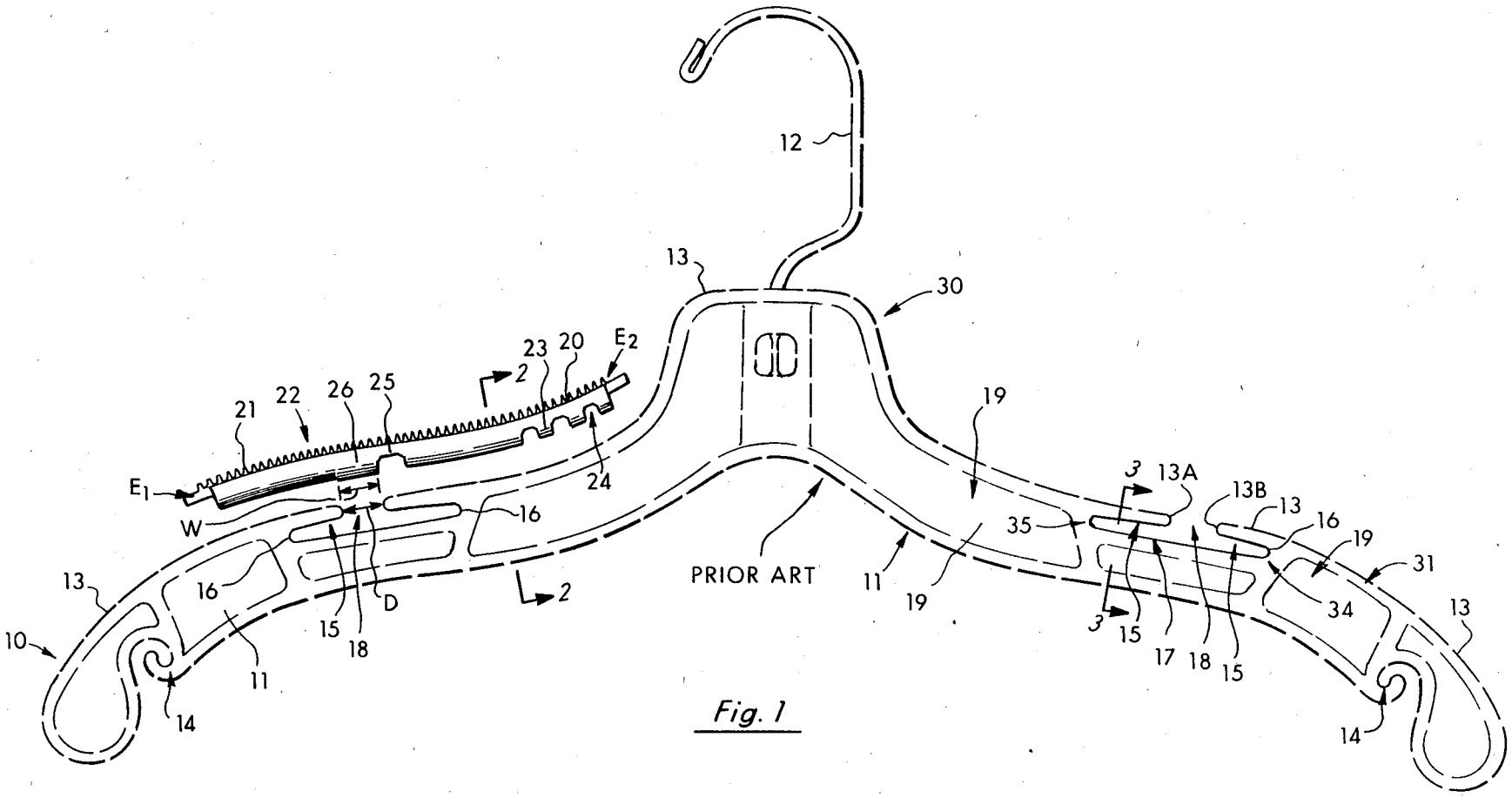
FIG. 1 is a side view of a prior art hanger shown with openings and slots in its upper arms and shown with an embodiment of my invention about to be installed for use.
Figure 7:
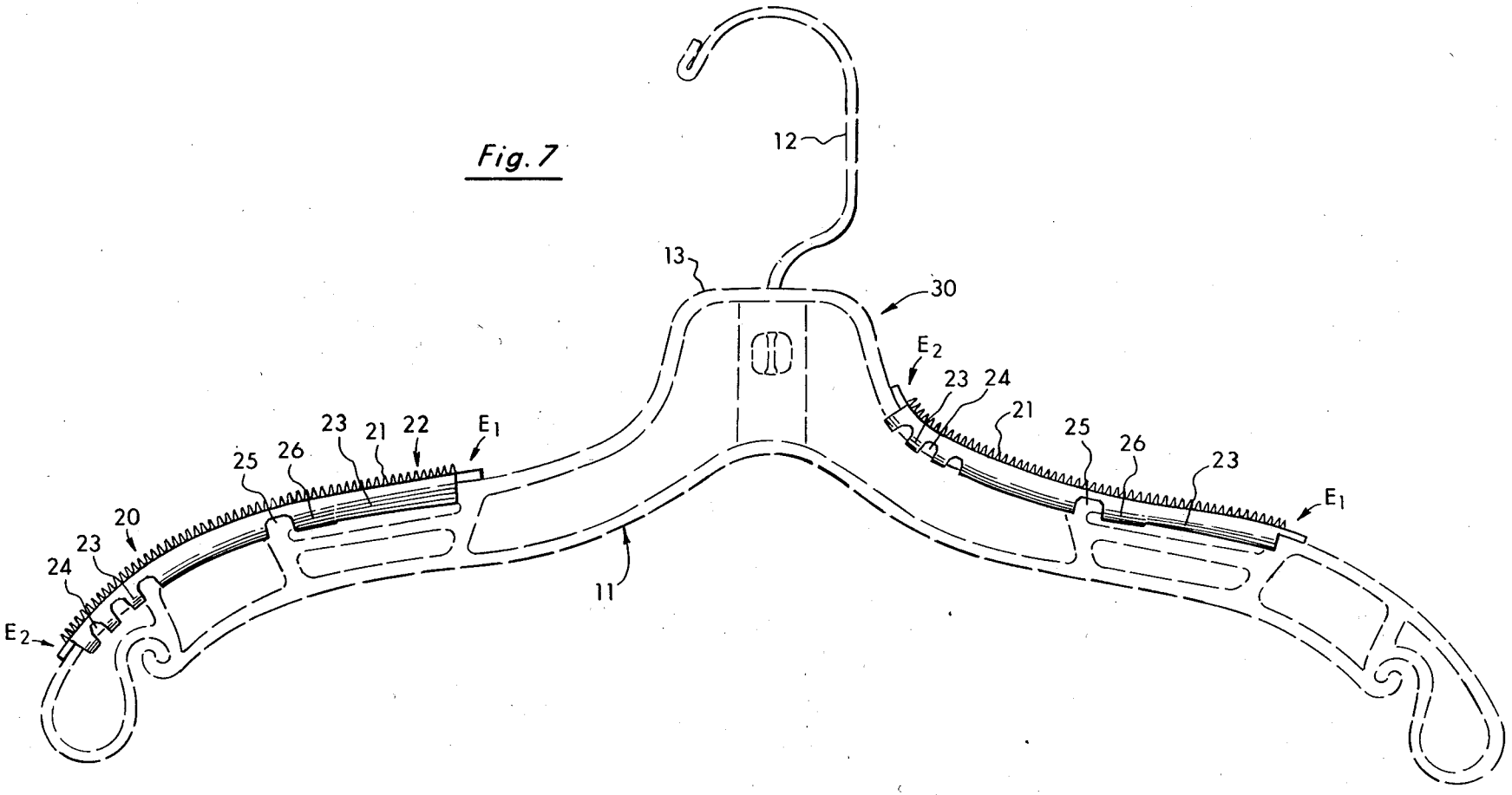
FIG. 7 is a side view showing a hanger on which the embodiment of FIG. 1 is installed to illustrate other positions in which it may be used.

In FIG. 1, a prior art hanger on which my invention may be used is indicated at 10. The hanger has an arm 11 on which garments are hung and which is adapted to be supported at its center by means such as hook 12. Arm 11, which is commonly made from rigid plastic material, has a generally I-shaped cross section defining a pair of flanges as may be observed in FIG. 2, so that the hanger arm 11 is both strong and light in weight. The I-shape is also advantageous because the upper flange 13 of the arm provides a wide upper edge so that garments which are hung over the arm are not creased by the hanger.

In the hanger shown, arm 11 has hooks 14 at its ends so that garments having narrow straps, such as, for example, ladies slips, or hanging loops as are often provided inside the waist of a skirt, may be conveniently supported. The hanger also has a slot 15 on each side of arm 11 under the upper edge or flange 13. The slots 15 are adapted to receive wider straps of a garment, such as, for example, shoulder straps of an evening dress, for hanging.

Each slot 15 also has a wide lip or flange portions around its edges, as indicated at 13 and 17 in FIGS. 1 and 3. The upper edge or flange 13 of the arm projects over slot 15 a sufficient distance so that many kinds of garments hung over the arm do receive adequate, continuous support. But, since an opening 18 is provided over each slot 15 through the upper edge so that hanging straps may be readily inserted into the slots, some hazards are introduced, particularly for loose knit garments or delicate fabrics. The opening has a width "D" and the upper edge or flange 13 of the arm which projects from the higher side of the hanger forms an upper projection designated as 13A and the upper edge or flange 13 of the arm which projects from the lower sides of the hanger forms a lower projection designated as 13B. Typically the opening "D" is from about one quarter to about one inch wide. As designated in FIG. 1, the slot 15 has a length from about one to about three inches. Preferably the distance "D" is about one half inch and the slot length 15 is about two inches. In the normal symmetrical hanger having a left and a right arm section; the upper flange is separated to form a pair of spaced end projections on each arm of the hanger. However, as can be readily seen in FIG. 1, each of these projections 13A and 13B, in association with the slot 15, have a hook-like shape which can catch certain kinds of garments, such as those made of loose knit fabrics if the projections 13A and 13B are not covered while the hanger 10 is used to support such garments.

An embodiment of my invention which is especially adapted for use on hanger 10 is identified by number 20 in the drawings. As indicated in FIGS. 4–6 the slip-preventing means of this embodiment has the general configuration of a sleeve type member that is open along at least a portion of its lower surface. It may be fabricated from many different flexible, resilient materials such as, for example, rubber, polyvinylchloride (PVC), synthetic rubber or a thermoplastic. I have found that polyethylene plastic material is particularly satisfactory for this purpose. Polyethylene and PVC are advantageous because they may be readily and inexpensively cast or molded in a desired shape and size and have suitable flexibility. There are also other plastic materials which are suitable.

The slip preventing means which I provide has an upper surface of uneven contour so that there will be large friction forces between the upper surface and any item which bears against it. That is to say, I provide an uneven contour in the upper surface of my slip preventing means so that there are large coefficients of friction between that surface and any item bearing against it. Using the polyethylene material mentioned above, for the embodiment shown, such an uneven contour may be readily provided in the form of a plurality of short, blunt, bristle-like projections 21 which are molded integrally with the member 20 so that they stand out from the upper surface 22.

The member 20 of the present embodiment has flexible lip portions 23 along the sides of upper surface 22. The lip portions 23 curl under the upper surface portion of the member 20 (as may be seen in FIGS. 2, 4 or 6) to engage and grip the flange 13 and hold the device in place when it is installed on the hanger. The lip portions may also have one or more serrations, as at 24, so that the means 20 remains in place even though it is installed in a position where the upper edge or lower edge of the hanger arm have a high degrees of curvature. The lip portions of this embodiment also have serrations at 25, the purpose of which is explained below.

Being flexible, the embodiment may be easily positioned so that it embraces the upper edge 13 of hanger arm 11. It may be snapped over the flange 13 and slid into place above the openings 18. Lip portions 23 grip the edge of the arm and thereby aiding in preventing the means of this embodiment from sliding around the edge 13 and from pulling off. The wider serrations 25 permit the lip portions to abut against the widened edges or flanges at the ends of slots 15 and serve to hold the member 20 from longitudinal movement along the hanger arm as well as to aid in mounting a cuff 26 which embracingly encompasses a projection, e.g. 13A or 13B of the flange 13 which projects over the top of slot 15. As best seen in FIG. 8, serration 25A located on the opposite side of cuff 26, need not be the same width as serration 25. In a preferred embodiment of this invention, serration 25A does not exist. That is to say that the lip portion 23A on one side of the cuff 26 attaches and extends from the cuff 26 as shown in FIG. 4. The cuff 26 is located interior to the ends $E_1$ and $E_2$ of member 20.

Such an arrangement remains functional because the center or web portion 19 of the I-shaped arm is not present in the slots 15, so that the sleeve configuration need not be opened along the bottom surface at the cuff 26 to accommodate the cuff 26 as its core 27 encompasses projection 13A or projection 13B. As is more readily apparent in FIGS. 8 and 9, the cuff 26 is open at both its ends 28 and 29 to form the core 27.

Preferably, the cuff 26 has a width W (see FIG. 8) which is slightly less than the distance D across the opening 18 between upper projection 13A and lower projection 13B. A width W of about one quarter to about one half inch will allow the cuff 26 to be inserted into the opening 18 of most commercial hangers of this type. A width W in this range greatly aids in inserting one of the projections 13A or 13B into the core opening 27 of the cuff 26. The presence of serrations 25 adjacent to the cuff 26 aids in mounting the cuff 26 to a projection 13A or 13B.

The cuff 26 is attached interior to the longitudinal ends $E_1$ and $E_2$ of member 20 as shown in FIG. 8. Preferably tab portions $T_1$ and $T_2$ of member 20 which extend beyond the cuff section 26 are of unequal length $L_1$ and $L_2$ respectively, as is also shown in FIG. 8. These unequal lengths $L_1$ and $L_2$ provide more versatility in covering different regions of the upper surface of the hanger arm 11. The cuff 26 should, however, be sufficiently interior to the closest end $E_1$, such that the length $L_1$ of the shorter tab section $T_1$, is greater than the distance D across the opening 18 regardless of which projection (13A or 13B) the cuff 26 encompasses. A length $L_1$ from about one inch to about three inches is preferred and a length from about one to one and one-half inches is most preferred. A length $L_2$ from about one and one-half to about three and one-half inches is preferred with the most preferred length $L_2$ being from about two and one quarter to about two and three quarter inches.

These lengths, in effect, enable the upper surface 22 of the member 20 above tabs $T_1$ or $T_2$ to bridge the opening 18 between projections 13A and 13B and thereby enabling the hanger 10 to support garments which might otherwise get caught on projections 13A or 13B as the garments are moved or removed from the hanger arm 11.

The member 20 can be mounted to the hanger 10 in a variety of positions. For example, opening 29 of cuff 26 could engagingly encompass projection 13A such that tab $T_1$ extends toward the collar region 30 of the hanger as shown in FIG. 1; similarly, opening 28 of the cuff 26 can engagingly encompass projection 13B such that tab $T_1$ still bridges the opening 18 as tab $T_1$ extends toward the collar area 30 of the hanger. In the later case, however, the longer tab $T_2$ will extend farther toward the arm region 31 of the hanger arm 11 to provide more frictional forces in the arm region 31 if the frictional forces are needed there to support a particular garment.

Conversely, the longitudinal orientation of the member 20 can be reversed such that tab $T_1$ extends toward the arm region 31 of the hanger and tab $T_2$ extends upward toward the collar region 30 of the hanger arm 11. Here again the fact that the cuff 26 has openings 28 and 29 on each side provides an added measure of versatility to the slip preventing means 20. Opening 29 can engagingly encompass projection 13B or opening 28 can engagingly encompass projection 13A so that tab $T_2$ extends toward the collar region 30 to the fullest extent possible.

One additional degree of versatility is provided when the cuff 26 is provided with a longitudinal slit 26A in the lower portion of the cuff 26 as shown in FIG. 8. Preferably, this slit 26A will not create a longitudinal opening 29 as wide as the opening 31 between the lips 23. The relative narrowness of longitudinal opening 29 helps maintain the ability of the core 27 to tightly grip one of the projections, e.g., 13A or 13B. However, given the flexibility of the material from which the member 20 is made, the slit 26A will enable cuff 26 to be slid past the end portions 34 and 35 of the slot 15 and on to the web portions 19 of the hanger arm 11. Therefore, slit 26A provides the capability of sliding the member 20 down the hanger arm 11 far enough that tab $T_1$ no longer bridges opening 18 so that the opening 18 is again able to receive straps of hanging garments. The opening can also be exposed by sliding member 20 upward toward the collar region 30 to the extend that opening 18 is able to receive straps which suspend an evening dress, etc. Slit 26A also provides the capability of inserting a strap which supports a garment into the opening 18 and then closing the opening 18 by again sliding tab $T_1$ or tab $T_2$ over the opening 18 to completely bridge the opening 18 so that the hanger 10 is again capable of hanging other garments which might otherwise be endangered by openings 18. This capability is particularly useful in displaying garment ensembles having strap supported garments such as evening dresses and matching jackets and the like which are more safely supported by a hanger arm 11 having no opening, notches or hook-like projections.

Other configurations may be provided for the hanger shown and for other types of hangers. I have described my invention by illustrating an embodiment which is especially adapted for the hanger 10 shown in the drawings because this type of hanger has wide use in commerce today. Large quantities of such hangers may be used in one large clothing store, for example, and they represent a substantial investment by the owner. They are especially desirable for use in ladies wear departments or stores because the slots 15 and hooks 14, described above, permit a diversity of uses so that only one type of hanger is required. This capability is especially convenient in a crowded showcase or closet, for example, where many garments are hung and removed frequently. Pressure of adjacent garments may cause the one which is being moved to be pulled off its hanger and vice versa. Additional time and care is required to prevent such occurrences in hanging such garments as a silk dress, nightgown, silk-lined jacket and peignoir; or the expense of providing a completely different type of hanger must be borne.

With my invention, one type of hanger can be used in all of these applications. The slip preventing means which I provide is readily manufactured at very low unit cost. Two can be quickly and inexpensively installed on a hanger to enhance its usefulness for garments which are hung over the hanger arm. These slip preventing means may just as readily be removed as desired, or simply left in place because they do not detract from the other useful features of the hanger. Hooks 14 may be used in the ordinary way. The same is true for the slots 15 because having a slit 26A as a preferred embodiment of the cuff 26, the member 20 can be slid up or down the hanger arm 11 enough to expose the opening 18. Moreover, the flexible bristle-like projections 21 provide an upper surface 22 which has a blunt or rounded end so that it does not catch garments, and even garments of rough or nappy fabric can be accommodated with ordinary facility. In all cases where garments are hung over the arm of hangers on which slip preventing means of my invention are installed, friction forces which are exerted on the garments enhance assurance that they will stay in place.

I have disclosed and described my invention with detailed references to particular embodiments thereof. Changes and departures from these embodiments may be made without departing from the spirit and scope of the invention. That scope is defined by the claims which follow.

I claim:

1. In a garment hanger and slip preventing means installed upon said hanger, said hanger having a generally I-shaped cross-section, the vertical component of the I-shape being a vertically extending web and the upper and lower horizontal portions of the I-shape defining a pair of flanges which extend along the upper and lower edges of said vertical web, the upper flange of said hanger being adapted to support the shoulder portions of a garment, said upper flange being interrupted and separated to form two pairs of spaced end projections between which the shoulder straps of a garment may be hung, said slip preventing means comprising a generally channel-shaped member of relatively flexible material conforming to the contours of the hanger, said channel-shaped member having an upper surface of uneven contour for creating friction on garments, a yoke-like underside which rests upon the upper flange portion of the hanger, a plurality of inwardly curved fingers formed along both side edges of said yoke, said fingers engaging the side and bottom edges of said upper flange to aid in holding said channel-shaped member in place thereon, wherein the improvement comprises:

(1) a cuff extending from said upper surface, said cuff being:

(a) open on each end for completely encompassing and engaging a projection in the upper flange;

(b) located interior to the ends of the member to such an extent that each end of the upper surface extending longitudinally from the cuff extends beyond the cuff a distance sufficient for the upper surface of the member to bridge the opening in the upper flange between pairs of spaced end projections;

(c) bound on one side by a first extended lip portion which extends from the cuff toward one end of the member; and (d) bound on the opposite side by a serration which separates the cuff from a second extended lip portion, and (2) a second extended lip portion of greater width than any one of the inwardly curved fingers and located between the cuff and the plurality of inwardly curved fingers which are located at the other end of the member.

2. Slip preventing means in accordance with claim 1, wherein said upper surface, fingers and cuff are all integrally molded of a resilient material having a relatively high frictional coefficient and selected from the group consisting of rubber, synthetic rubber and polyethylene plastics.

3. In a garment hanger and slip preventing means installed upon said hanger, said hanger having a generally I-shaped cross-section, the vertical component of the I-shaped being a vertically extending web and the upper and lower horizontal portions of the I-shape defining a pair of flanges which extend along the upper and lower edges of said vertical web, the upper flange of said hanger being adapted to support the shoulder portions of a garment, said upper flange being interrupted and separated to form two pairs of spaced end projections between which the shoulder straps of a garment may be hung, said slip preventing means comprising a generally channel-shaped member of relatively flexible material conforming to the contours of the hanger, said channel-shaped member having an upper surface of uneven contour for creating friction on garments, a yoke-like underside which rests upon the upper flange portion of the hanger, a plurality of inwardly curved fingers formed along both side edges of said yoke, said fingers engaging the side and bottom edges of said upper flange to aid in holding said channel-shaped member in place thereon, wherein the improvement comprises:

(1) a cuff extending from said upper surface, said cuff being:

(a) open on each end for substantially encompassing and engaging a projection in the upper flange, but provided with a slit so that said cuff can be slid over the vertical web to an extent that the upper surface of the member does not cover the opening in order that said opening can receive straps which support garments;

(b) located interior to the ends of the member to such an extent that each end of the upper surface extending longitudinally from the cuff extends beyond the cuff a distance sufficient for the upper surface of the member to bridge the opening in the upper flange between pairs of spaced end projections;

(c) bound on one side by a first extended lip portion which extends from the cuff toward one end of the member; and (d) bound on the opposite side by a serration which separates the cuff from a second extended lip portion, and (2) a second extended lip portion of greater width than any one of the inwardly curved fingers and located between the cuff and the plurality of inwardly curved fingers which are located at the other end of the member.

4. Slip preventing means in accordance with claim 3, wherein said upper surface, fingers and cuff are all integrally molded of a resilient material having a relatively high frictional coefficient and selected from the group consisting of rubber, synthetic rubber, polyethylene plastics, and flexible PVC.

5. Slip preventing means in accordance with claim 3, wherein said upper surface, fingers and cuff are all integrally molded of a resilient material having a relatively high frictional coefficient and selected from the group consisting of rubber, synthetic rubber and polyethylene plastics.

* * * * *